US005663524A

United States Patent [19]

Bucerius et al.

[11] Patent Number: 5,663,524

[45] Date of Patent: Sep. 2, 1997

[54] GAS GENERATING MIXTURE CONTAINING COPPER DIAMMINE DINITRATE

[75] Inventors: Klaus Martin Bucerius, Karlsruhe; Norbert Eisenreich, Pfinztal; Helmut Schmid, Karlsruhe; Walter Engel, Wöschbach, all of Germany

[73] Assignee: Fraunhofer-Gesellschaft Zur Forderung Der Angewandten Forschung E.V., Munich, Germany

[21] Appl. No.: 562,602

[22] Filed: Nov. 24, 1995

[30] Foreign Application Priority Data

Nov. 26, 1994 [DE] Germany ..... 44 42 169.9

[51] Int. Cl.[6] ..... C06B 31/00

[52] U.S. Cl. ..... 149/45; 149/36; 149/92

[58] Field of Search ..... 149/45, 36, 92

[56] References Cited

U.S. PATENT DOCUMENTS

| | | | |
|---|---|---|---|
| 2,220,891 | 11/1940 | Cook et al. . | |
| 3,814,694 | 6/1974 | Kloger et al. . | |
| 4,925,600 | 5/1990 | Hommel et al. | 149/109.6 |
| 5,125,684 | 6/1992 | Cartwright | 149/19.7 |
| 5,160,386 | 11/1992 | Lund et al. | 149/88 |
| 5,516,377 | 5/1996 | Highsmith et al. | 149/18 |
| 5,542,998 | 8/1996 | Bucerius et al. | 149/45 |
| 5,542,999 | 8/1996 | Bucerius et al. | 149/45 |
| 5,592,812 | 1/1997 | Hinshaw et al. | 149/45 |

*Primary Examiner*—Edward A. Miller

*Attorney, Agent, or Firm*—Antonelli, Terry, Stout & Kraus, LLP.

[57] ABSTRACT

A gas generating mixture comprises a high nitrogen and low carbon fuel from the group nitroguanidine (NIGU), triaminoguanidine nitrate (TAGN), diguanidinium-5,5'-azotetrazolate (GZT) and 3-nitro-1,2-3-triazol-5-one (NTO), as well as copper diammine dinitrate $Cu(NH_3)_2(NO_3)_2$ as the oxidizer and $V_2O_5/MoO_3$ mixed oxides and/or oxide mixtures as the catalyst.

8 Claims, 1 Drawing Sheet

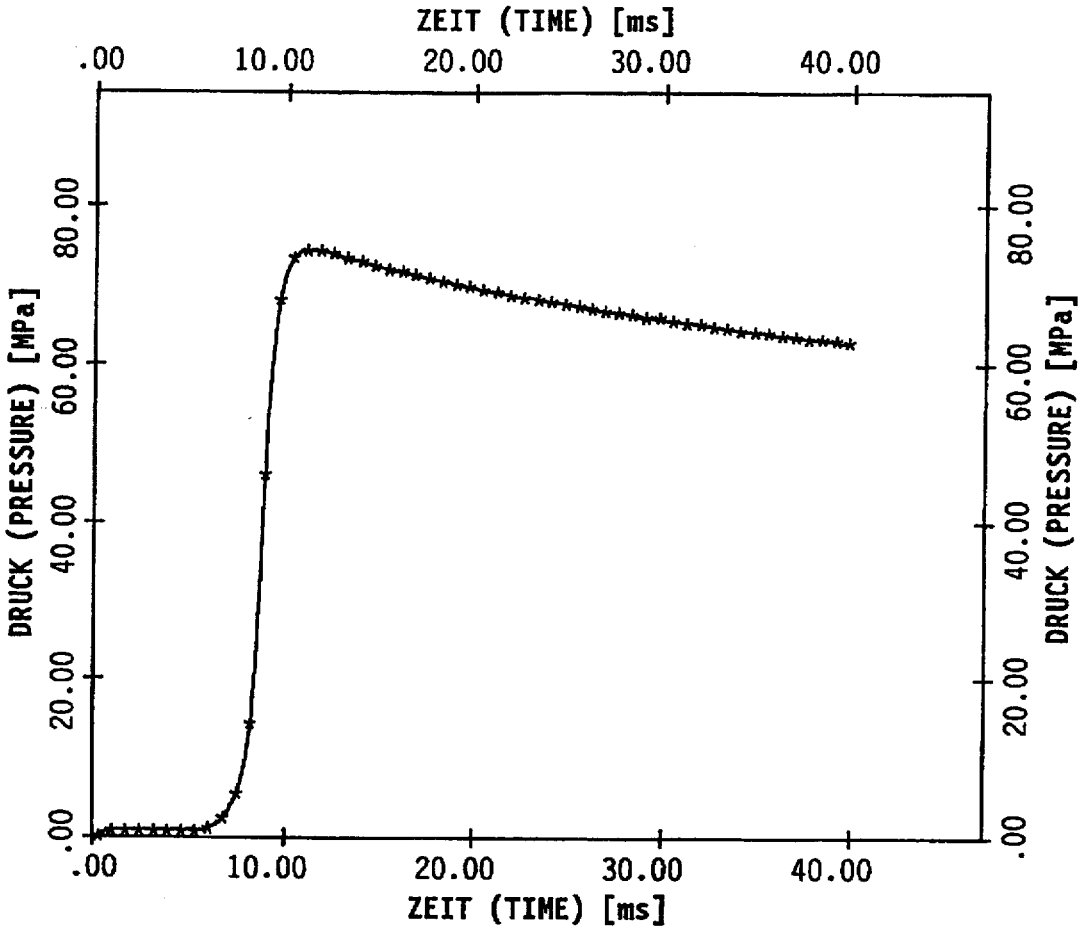
ZEIT (TIME) [ms]
.00
10.00
20.00
30.00
40.00
DRUCK (PRESSURE) [MPa]
.00
20.00
40.00
60.00
80.00

GAS GENERATING MIXTURE CONTAINING COPPER DIAMMINE DINITRATE

FIELD OF THE INVENTION

The invention relates to a gas generating mixture comprising a high nitrogen and low carbon fuel from the group nitroguanidine (NIGU), triaminoguanidine nitrate (TAGN), diguanidinium-5,5'-azotetrazolate (GZT) and 3-nitro-1,2,3-triazol-5-one (NTO), catalysts, oxidizers and optionally coolants.

BACKGROUND OF THE INVENTION

Gas generating mixtures of the aforementioned type, also known as gas generator sets, are characterized in that during combustion they allow a high gas output (>14 mole/kg). They are used for inflatable retaining (airbag) and rescue systems, fire extinguishing equipment and for insensitive solid fuels for rocket and tubular weapon drives. Particularly in the civil sector it is also necessary to have thermomechanical insensitivity and non-toxicity on the part of the starting mixtures, as well as a lack of toxicity in the resulting gases. Many systems in use do not or only very inadequately fulfil these requirements.

In airbag systems initially gas generating mixtures based on sodium azide were used and tested, but due to toxicity and the resulting solid particles has proved to be problematical. Similar problems have arisen with so-called hybrid gas generators, where use is made of nitramines or perchlorates.

Considerable efforts have been made to in particular provide non-toxic starting compounds. These more particularly include high nitrogen and low carbon fuels, such as TAGN, NIGU and NTO. Particularly good results have been obtained with diguanidium-5,5'-azotetrazolate (GZT) (DE 41 08 225). Both the starting mixture and also the resulting gases are largely non-toxic and mainly consist of nitrogen. However, it is disadvantageous that $NO_x$ is unavoidably formed and the burning behaviour is not always satisfactory. Numerous reaction mixtures have such a high combustion temperature that when used in airbag systems the thermally sensitive bag materials are damaged.

The problem of the invention is consequently to propose a gas generating mixture, which, like the combustion products thereof, is non-toxic and in particular has a low CO and $NO_x$ toxic gas content and which at low combustion temperatures has a high burning speed.

SUMMARY OF THE INVENTION

According to the invention this problem is solved in that the catalyst comprises $V_2O_5/MoO_3$ mixed oxides and/or oxide mixtures.

Through the use of copper diammine dinitrate as the oxidizer the burning behaviour of the reaction mixture can be adjusted within wide limits. A high burning rate is obtained, so that the maximum pressure builds up within a few milliseconds, although the combustion temperature is relatively low, so that in particular in airbag systems the thermally sensitive bag materials are not endangered.

The catalyst system comprises $V_2O_5/MoO_3$ mixed oxides and/or oxide mixtures, which can contain fractions of the thermodynamically unstable $V_2O_4$ phase, which can be prepared by a partial reduction of $V_2O_5$. Additional oxides such as $TiO_2$ can be incorporated as promoters. The complex action relationship of this system makes it necessary to provide a more precise description of the term "catalyst", which is used with a broad meaning. In the present context a "catalyst" is an active reaction component, which can itself be reacted and acts in a reaction controlling and/or reaction accelerating manner. In a phase of the reaction determined by the thermal stability of the oxides, the latter act as oxygen donors. The catalytic action with respect to the toxic gas conversion $CO+\frac{1}{2}O_2-CO_2$ is also dependent on the particle size distribution of the oxides and is preferably below 25 μm.

The catalyst system and oxidizer fulfil the thermomechanical stability requirements and are in particular non-hygroscopic, which guarantees a permanent functional efficiency and long life.

A preferred mixture type consists of GZT and the oxidizer $Cu(NH_3)_2(NO_3)_2$ in a weight ratio 0.216:0.784. In addition, said basic mixture, as a function of the requirements regarding the burning behaviour and the gas composition, contains up to 30 wt. % of the catalyst with the empirical formula $V_6Mo_{15}O_{60}$ (oxide mixture of $V_2O_5$ and $MoO_3$). It is also possible to admix a coolant, e.g. $Fe_2O_3$.

BRIEF DESCRIPTION OF THE DRAWING

The sole figure is a pressure vs. time graph showing this characteristic for an invention composition.

EXAMPLE

A mixture comprising GZT and the oxidizer $Cu(NH_3)_2(NO_3)_2$ in a wt. % ratio 21.6:78.4 is prepared. As a function of the aforementioned requirement profile, into said basic mixture are homogeneously incorporated up to 30 wt. % of the catalyst $V_6Mo_{15}O_{60}$ (oxide mixture of $V_2O_5$ and $MoO_3$). The said formulations are characterized with respect to their ignition and combustion behaviour with the aid of experiments in the ballistic bomb. For this purpose the pressure/time diagrams are established. It can be gathered from the attached diagram that the reaction mixtures have good ignition and combustion characteristics. For a loading density of 0.1 g/cm$^3$ there are maximum pressures of 74.6 MPa, which are reached after approximately 11.4 ms (t(pmax)= 11.4 ms). The pressure rise times between 30 and 80% of the maximum pressure amount to approximately 0.8 ms ($t_{30-80}$= 0.8 ms).

We claim:

1. Gas generating mixture comprising a high nitrogen and low carbon fuel selected from the group consisting of nitroguanidine (NIGU), triaminoguanidine nitrate (TAGN), diguanidinium-5,5'-azotetrazolate (GZT) and 3-nitro-1,2,3,-triazol-5-one (NTO), catalyst, oxidizer and optionally coolant, wherein the oxidizer is copper diammine dinitrate $Cu(NH_3)_2(NO_3)_2$ and the catalyst comprises at least one of $V_2O_5/MoO_3$ mixed oxides and oxide mixtures.

2. Mixture according to claim 1, wherein the catalyst is an oxide mixture with the empirical formula $V_6Mo_{15}O_{60}$.

3. Mixture according to claim 1 wherein the catalyst contains fractions of the thermodynamically unstable $V_2O_4$ phase.

4. Mixture according to claim 1, wherein the catalyst also contains $TiO_2$.

5. Mixture according to claim 1, wherein the catalyst has an average particle size of<25 μm.

6. Mixture according to claim 1, wherein said mixture comprises a mixture of GZT, $Cu(NH_3)_2(NO_3)_2$ with an equilibrated oxygen balance and a catalyst content in the mixture of up to 30 wt. %.

7. Mixture according to claim 6, wherein GZT and $Cu(NH_3)_2(NO_3)_2$ are present in a wt. % ratio of 21.6:78.4.

8. Mixture according to claim 1, wherein the coolant wholly or partly comprises $Fe_2O_3$.

* * * * *